US009653851B1

(12) United States Patent
Yuan et al.

(10) Patent No.: US 9,653,851 B1
(45) Date of Patent: May 16, 2017

(54) ELECTRICAL CONNECTOR

(71) Applicant: Cheng Uei Precision Industry Co., Ltd., New Taipei (TW)

(72) Inventors: Sheng-Tsung Yuan, New Taipei (TW); Sheng-Nan Yu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/075,100

(22) Filed: Mar. 18, 2016

(51) Int. Cl.
*H01R 13/648* (2006.01)
*H01R 13/6594* (2011.01)
*H01R 13/652* (2006.01)
*H01R 24/60* (2011.01)

(52) U.S. Cl.
CPC ..... *H01R 13/6594* (2013.01); *H01R 13/652* (2013.01); *H01R 24/60* (2013.01)

(58) Field of Classification Search
CPC ..... H01R 13/6594
USPC ..... 439/607.4, 607.01
See application file for complete search history.

(56) References Cited

U.S. PATENT DOCUMENTS 9,281,643 B1 * 3/2016 Tseng ..... H01R 13/518
9,300,095 B2 * 3/2016 Lin ..... H01R 24/60
2015/0229077 A1 * 8/2015 Little ..... H01R 13/6582 439/78
2015/0244110 A1 * 8/2015 Ju ..... H01R 13/6585 439/607.01
2015/0244111 A1 * 8/2015 Ju ..... H01R 13/6585 439/607.05
2015/0364883 A1 * 12/2015 Yu ..... H01R 13/6594 439/607.27
2016/0056586 A1 * 2/2016 Guo ..... H01R 13/41 439/607.05
2016/0064869 A1 * 3/2016 Yu ..... H01R 24/60 439/607.05
2016/0064870 A1 * 3/2016 Yu ..... H01R 24/60 439/607.05
2016/0104975 A1 * 4/2016 Guo ..... H01R 13/6585 439/607.05
2016/0104976 A1 * 4/2016 Yu ..... H01R 13/6585 439/607.05
2016/0197443 A1 * 7/2016 Zhang ..... H01R 13/6585 439/607.05

* cited by examiner

*Primary Examiner* — Tulsidas C Patel
*Assistant Examiner* — Peter G Leigh
(74) *Attorney, Agent, or Firm* — Cheng-Ju Chiang

(57) ABSTRACT

An electrical connector includes an insulating housing, a plurality of conductive terminals, a shielding plate and a ground element. The insulating housing has a base portion, and a tongue portion protruded frontward from a front surface of the base portion. The conductive terminals are received in the insulating housing, and front ends of the conductive terminals are exposed to the tongue portion. The shielding plate is received in the insulating housing. The ground element is for being connected between the shielding plate and ground. The ground element is received in the insulating housing. The ground element has a touch portion contacting the shielding plate.

13 Claims, 14 Drawing Sheets

ELECTRICAL CONNECTOR

BACKGROUND OF THE INVENTION

1. Field of the Invention

The present invention generally relates to an electrical connector, and more particularly to a USB Type-C electrical connector.

2. The Related Art

In order to unify electrical connectors of different equipments for improving universalities of the electrical connectors, USB (Universal Serial Bus) connectors are the most popular interfaces of current computers. The USB connectors support plug-and-play external buses. The USB connectors are used for connecting with multiple kinds of peripheral devices, including loudspeakers, telephones, game controllers, printers, tablet devices, cameras and so on. With the popularization of the USB connectors, except for data transmissions, the current USB connectors are widely used in a charging field.

With the development of electronic industries, in order to make the USB connectors more popularly applied in various devices, and solve a drawback that a USB 2.0 connector need be distinguished an obverse surface from a reverse surface to be inserted, an innovative USB type C connector is emerged.

The USB type C connector generally includes an insulating housing, two groups of conductive terminals, a shielding plate and a shielding shell. The insulating housing has a base body, and a tongue board protruded frontward from a front surface of the base body. The two groups of conductive terminals are respectively mounted to a top surface and a bottom surface of the base body. The shielding plate is mounted in the tongue board. The shielding shell surrounds the insulating housing.

However, a rear of the shielding plate extends downward to form a ground portion that makes the shielding plate have a more complex and longer structure, so a mold for making the shielding plate is more complex and larger. As a result, a process problem of making the shielding plate is caused and a defect rate of the shielding plate is higher.

In order to improve the process problem of making the shielding plate and lower the defect rate of the shielding plate, a ground element is designed to realize a ground function for resisting high-frequency noises.

SUMMARY OF THE INVENTION

An object of the present invention is to provide an electrical connector. The electrical connector includes an insulating housing, a plurality of conductive terminals, a shielding plate and a ground element. The insulating housing has a base portion, and a tongue portion protruded frontward from a front surface of the base portion. The conductive terminals are received in the insulating housing, and front ends of the conductive terminals are exposed to the tongue portion. The shielding plate is received in the insulating housing. The ground element is for being connected between the shielding plate and ground. The ground element is received in the insulating housing. The ground element has a touch portion contacting the shielding plate.

Another object of the present invention is to provide an electrical connector. The electrical connector includes an insulating housing, a plurality of first terminals received in the insulating housing, a plurality of second terminals received in the insulating housing, a shielding plate and a grounding conductor. The insulating housing has a base portion, and a tongue portion protruded frontward from a front surface of the base portion. Each of the first terminals has a first contact portion exposed to a bottom surface of the tongue portion, a first fastening portion extended rearward from a rear end of the first contact portion to be fastened in the base portion, and a first bent portion bent downward from a rear end of the first fastening portion. Each of the second terminals has a second contact portion exposed to a top surface of the tongue portion, a second fastening portion extended rearward from a rear end of the second contact portion to be fastened in the base portion, and a second bent portion bent downward from a rear end of the second fastening portion and located behind the first bent portion of each of the first terminals. The shielding plate is received in the insulating housing. The grounding conductor for being connected between the shielding plate and ground is received in the base portion. The grounding conductor has a rear plate corresponding to and spaced from the second bent portions of the second terminals, a front plate corresponding to and spaced from the first bent portions of the first terminals, and a touch portion contacting the shielding plate.

As described above, the touch portion of the ground element contacts the shielding plate to make the shielding plate realize a ground function, so the shielding plate has a simpler and shorter structure, and a mold for making the shielding plate is simpler and litter. Furthermore, a distance between the front plate of the grounding conductor and the first bent portions of the first terminals is substantially equal to a distance between the rear plate of the grounding conductor and the second bent portions of the second terminals for resisting high-frequency noises, so the high-frequency noises are decreased. As a result, a process problem of making the shielding plate is improved, and a defect rate of the shielding plate is lowered.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
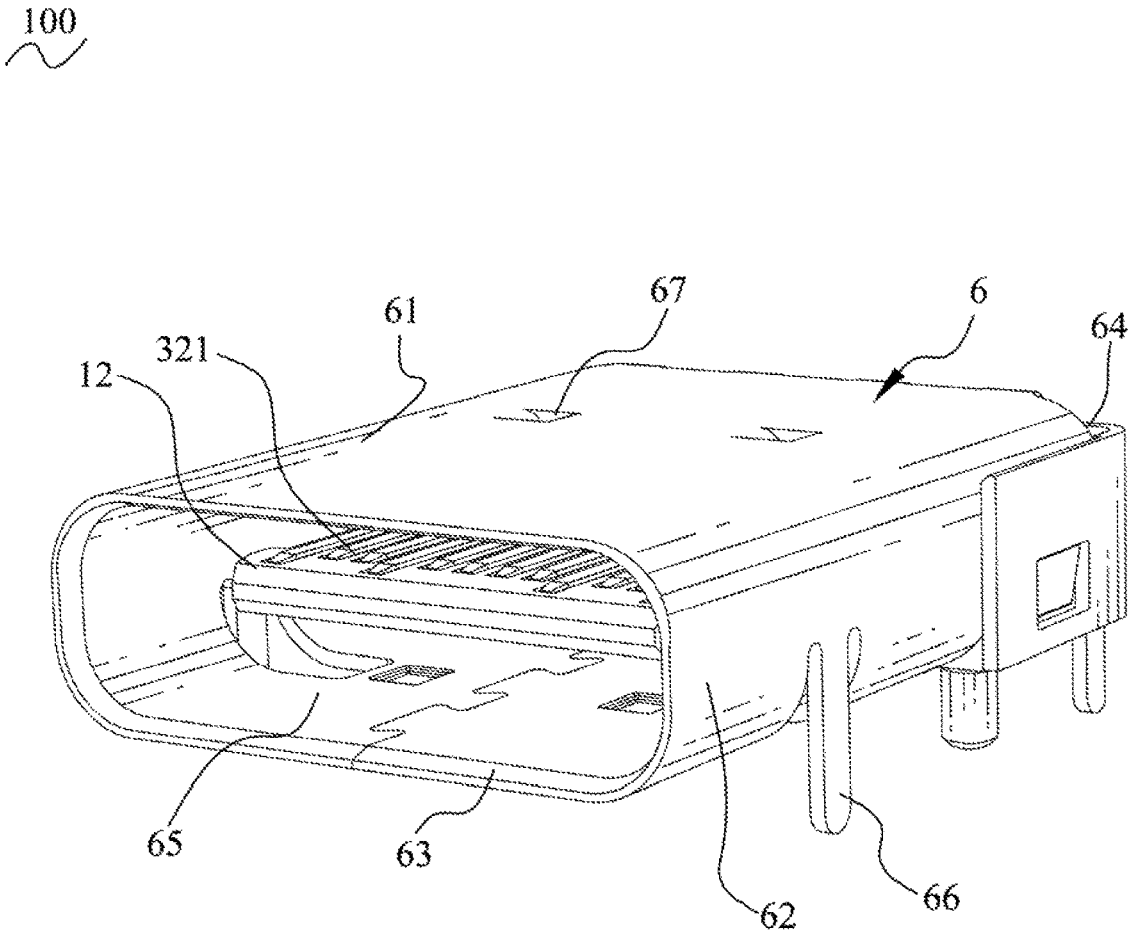
FIG. 1 is a perspective view of an electrical connector in accordance with an embodiment of the present invention.
Figure 2:
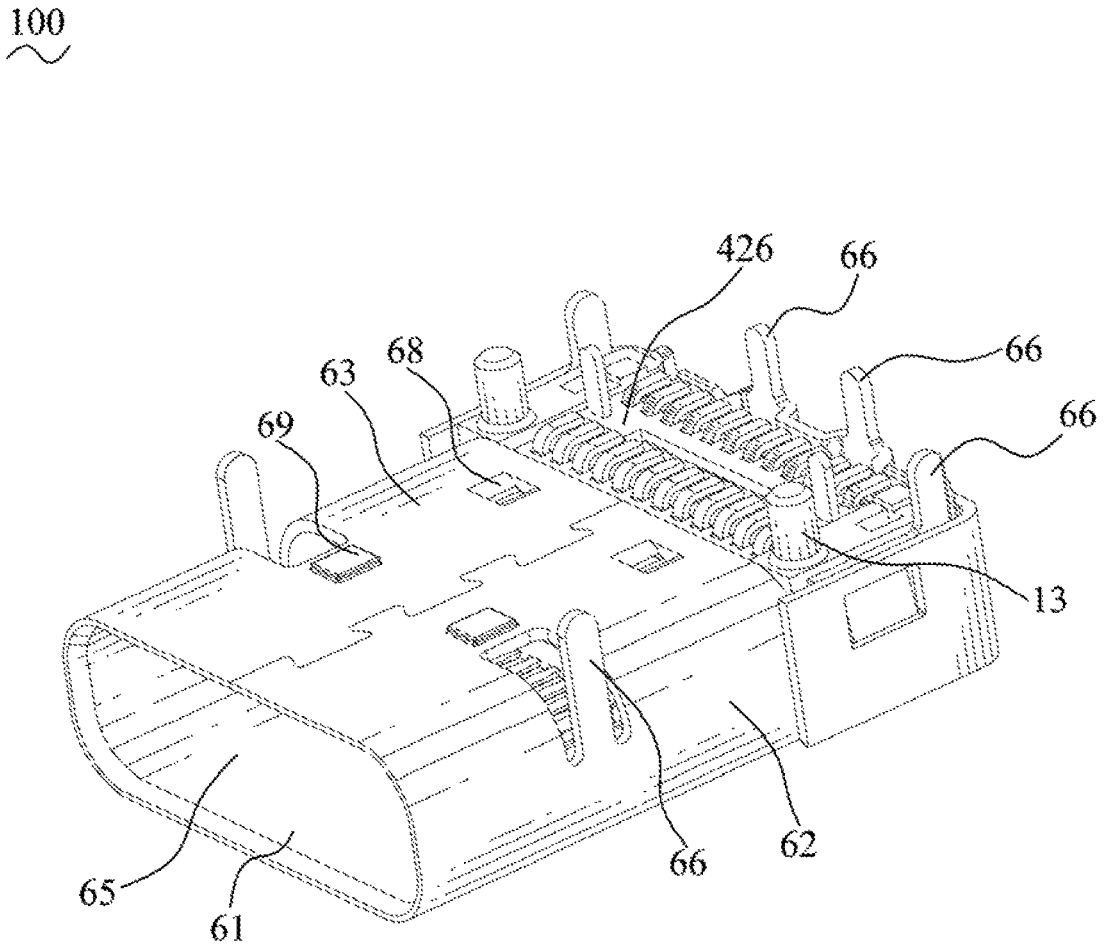
FIG. 2 is another perspective view of the electrical connector of FIG. 1.
Figure 3:
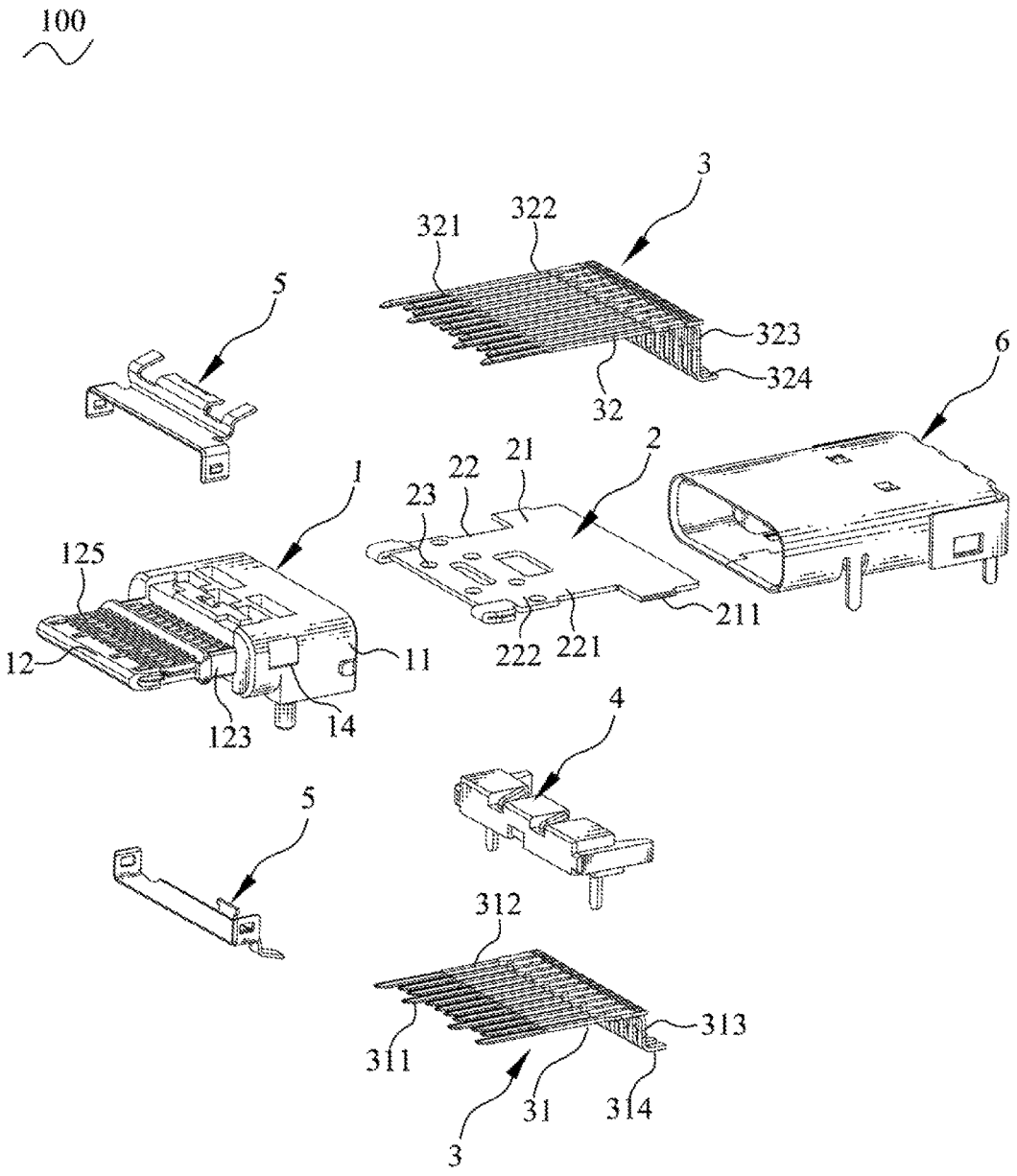
FIG. 3 is an exploded view of the electrical connector of FIG. 1.
Figure 4:
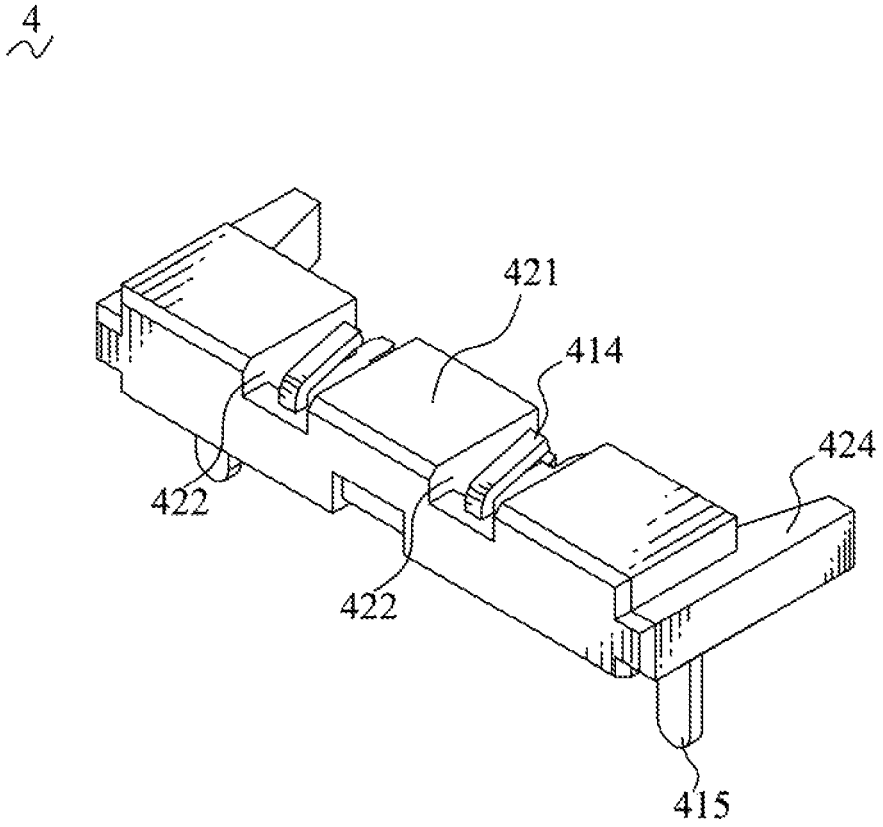
FIG. 4 is a perspective view of a ground element of the electrical connector of FIG. 1.
Figure 5:
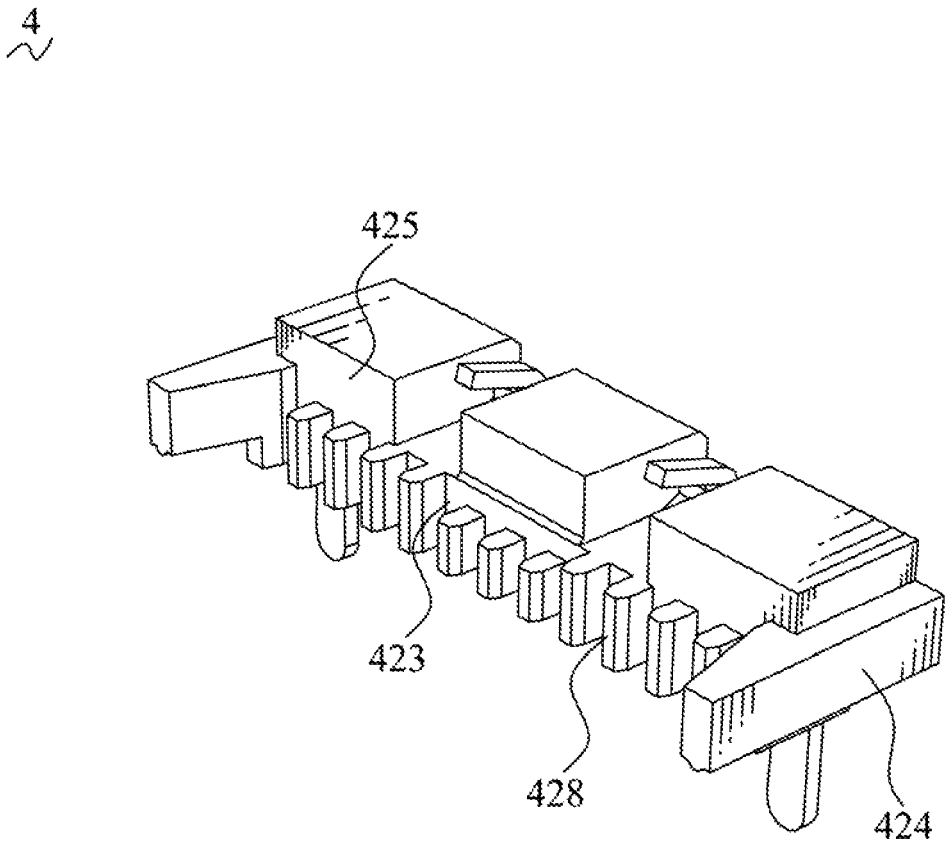
FIG. 5 is another perspective view of the ground element of the electrical connector of FIG. 4.
Figure 6:
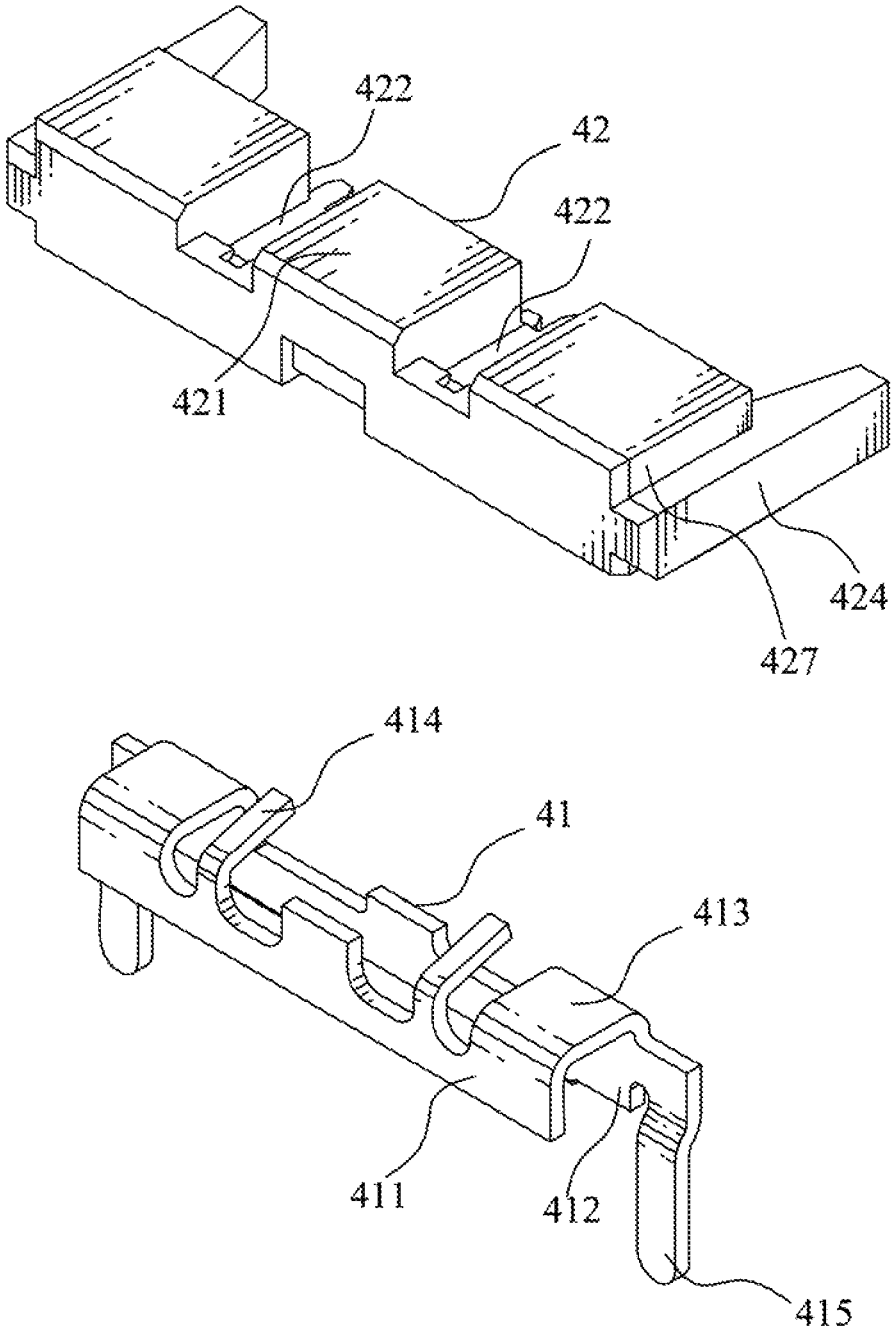
FIG. 6 is an exploded view of the ground element of the electrical connector of FIG. 4.
Figure 7:
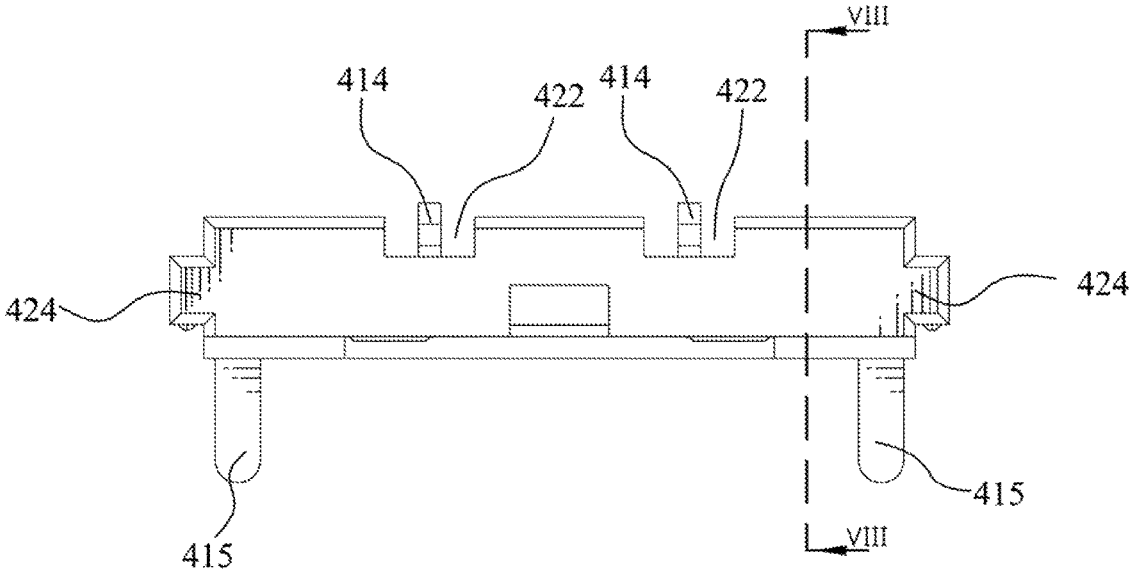
FIG. 7 is a front view of the ground element of the electrical connector of FIG. 4.
Figure 8:
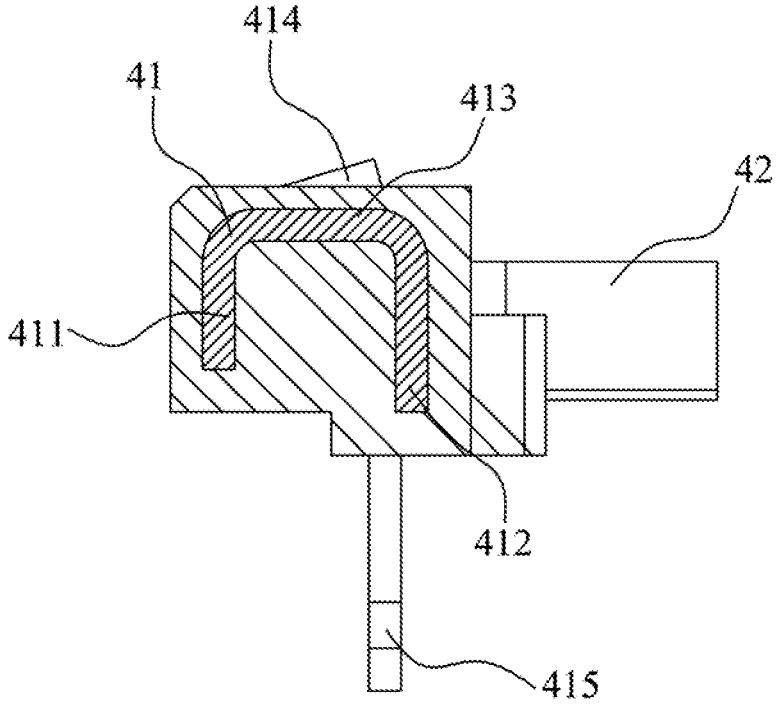
FIG. 8 is a sectional view of the ground element of the electrical connector along a line VIII-VIII of FIG. 6.
Figure 9:
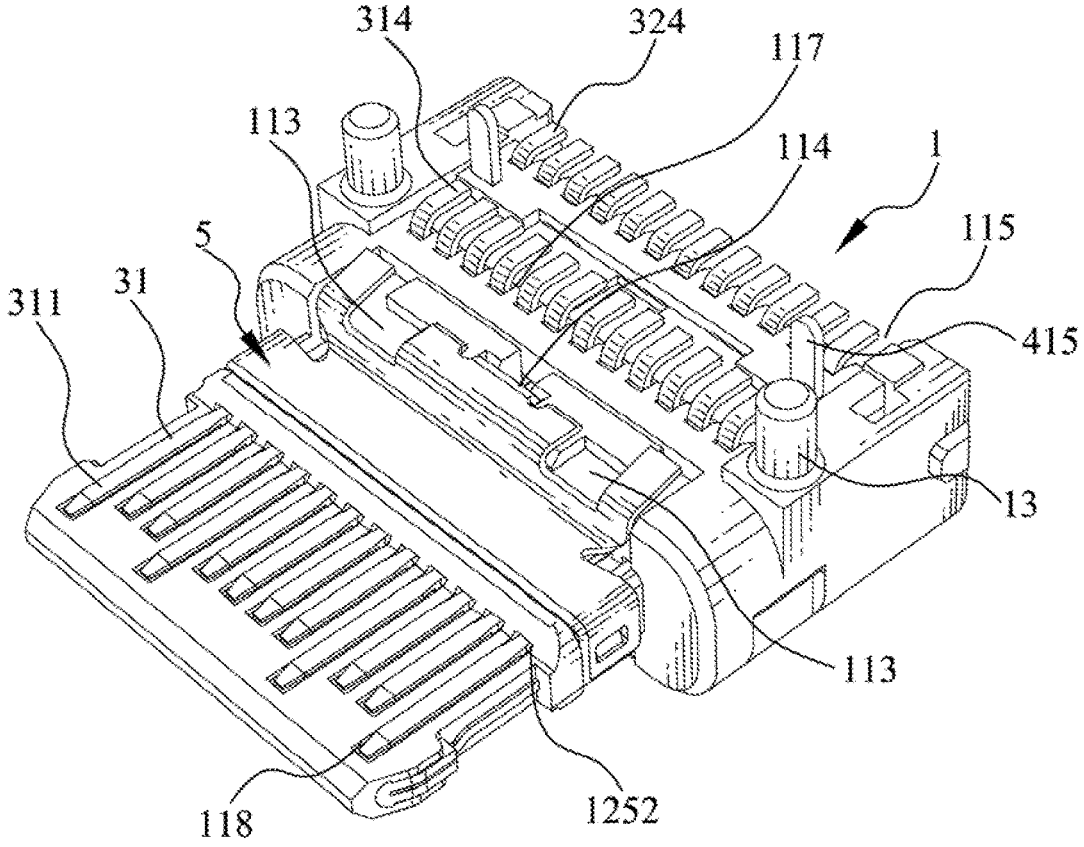
FIG. 9 is an assembling view of a terminal module and an inner shielding shell assembly of the electrical connector of FIG. 1.

With reference to FIG. 1 to FIG. 3, an electrical connector 100 in accordance with the present invention is shown. The electrical connector 100 mounted to a circuit board (not shown), includes an insulating housing 1, a shielding plate 2, a plurality of conductive terminals 3, a ground element 4, an inner shielding shell assembly 5 and an outer shielding shell 6. The shielding plate 2 is received in the insulating housing 1. The conductive terminals 3 are received in the insulating housing 1. The ground element 4 for being connected between the shielding plate 2 and ground is received in the insulating housing 1. The inner shielding shell assembly 5 is mounted on the insulating housing 1.

Referring to FIG. 1, FIG. 2, FIG. 3, FIG. 9, FIG. 10, FIG. 11 and FIG. 14, the insulating housing 1 is integrally molded by virtue of an injection way. The insulating housing 1 has a base portion 11, and a tongue portion 12 connected to a front surface of the base portion 11. The tongue portion 12 is protruded frontward from a middle of the front surface of the base portion 11. The base portion 11 defines an assembling opening 115 penetrating through a rear of a bottom surface and a rear surface of the base portion 11. Two opposite side walls of the assembling opening 115 are recessed inward to form two restricting grooves 116 penetrating through the rear surface of the base portion 11. The insulating housing 1 defines a plurality of first terminal grooves 117 extending in a bottom surface of the tongue portion 12 and extending rearward to penetrate the base portion 11 and communicate with the assembling opening 115. The insulating housing 1 defines a plurality of second terminal grooves 118 extending in a top surface of the tongue portion 12 and extending rearward to penetrate the base portion 11 and communicate with the assembling opening 115.

A front of a top surface of the base portion 11 defines two first recesses 111 penetrating through the front surface of the base portion 11. A middle of the top surface of the base portion 11 is concaved downward to form a first locking groove 112 located between the two first recesses 111. A front of the bottom surface of the base portion 11 defines two second recesses 113 penetrating through the front surface of the base portion 11. A middle of the bottom surface of the base portion 11 is concaved upward to form a second locking groove 114 located between the two second recesses 113. Two opposite sides of the bottom surface of the base portion 11 protrudes downward to form two cylindrical locating pillars 13. Two opposite sides of the base portion 11 define two perforations 14 communicated with the assembling opening 115.

A rear of a periphery of the tongue portion 12 is connected with a ring-shaped blocking rib 121. The blocking rib 121 is spaced from the front surface of the base portion 11 to form a receiving groove 123 between the blocking rib 121 and the base portion 11. A front end of the tongue portion 12 located in front of the blocking rib 121 is defined as a front section 122. A junction between the top surface and a front surface of the front section 122 and a junction between the bottom surface and the front surface are chamfered. An upper portion of the blocking rib 121 defines a plurality of first fixing grooves 1251 communicated with the first terminal grooves 117. A lower portion of the blocking rib 121 defines a plurality of second fixing grooves 1252 communicated with the second terminal grooves 118.

The front section 122 of the tongue portion 12 has a main portion 127, and two buckling portions 126 protruded outward from two opposite sides of the main portion 127. The two buckling portions 126 are buckled with two butting portions of a butting connector (not shown).

Figure 10:
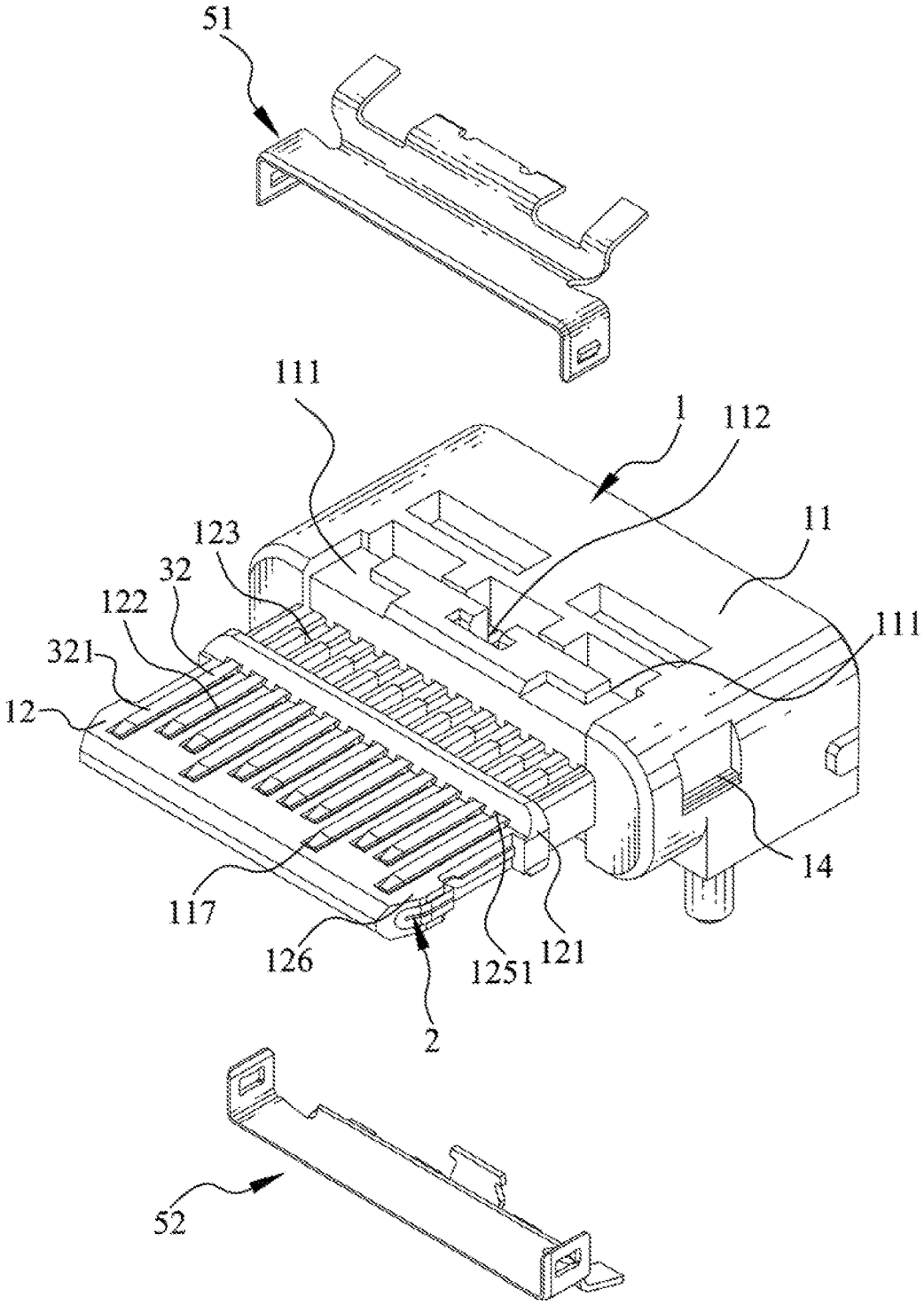
FIG. 10 is an exploded view of the terminal module and the inner shielding shell assembly of the electrical connector of FIG. 1.
Figure 11:
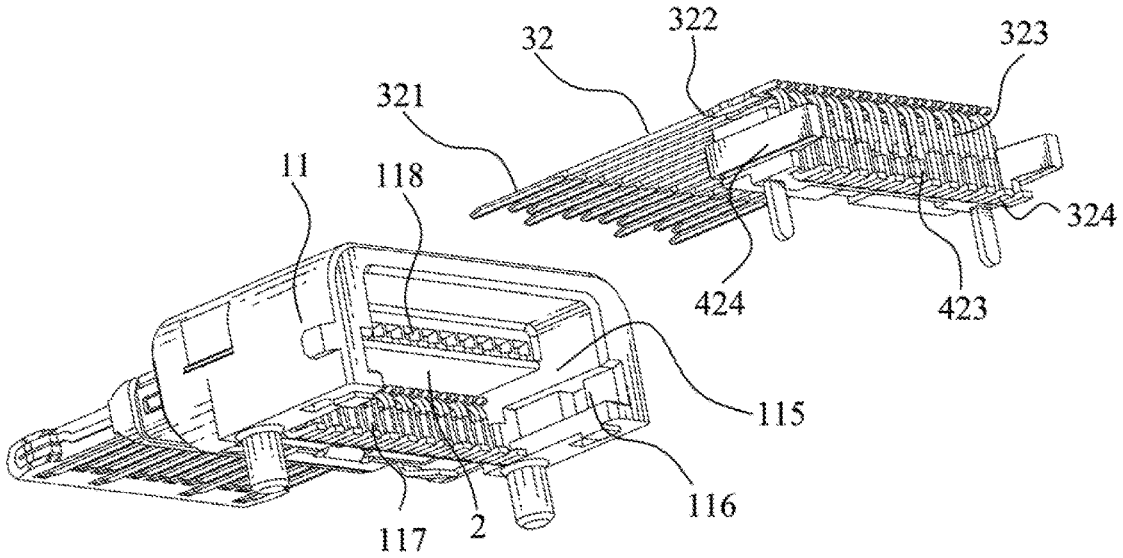
FIG. 11 is an exploded view of the ground element and the terminal module of the electrical connector of FIG. 1.
Figure 12:
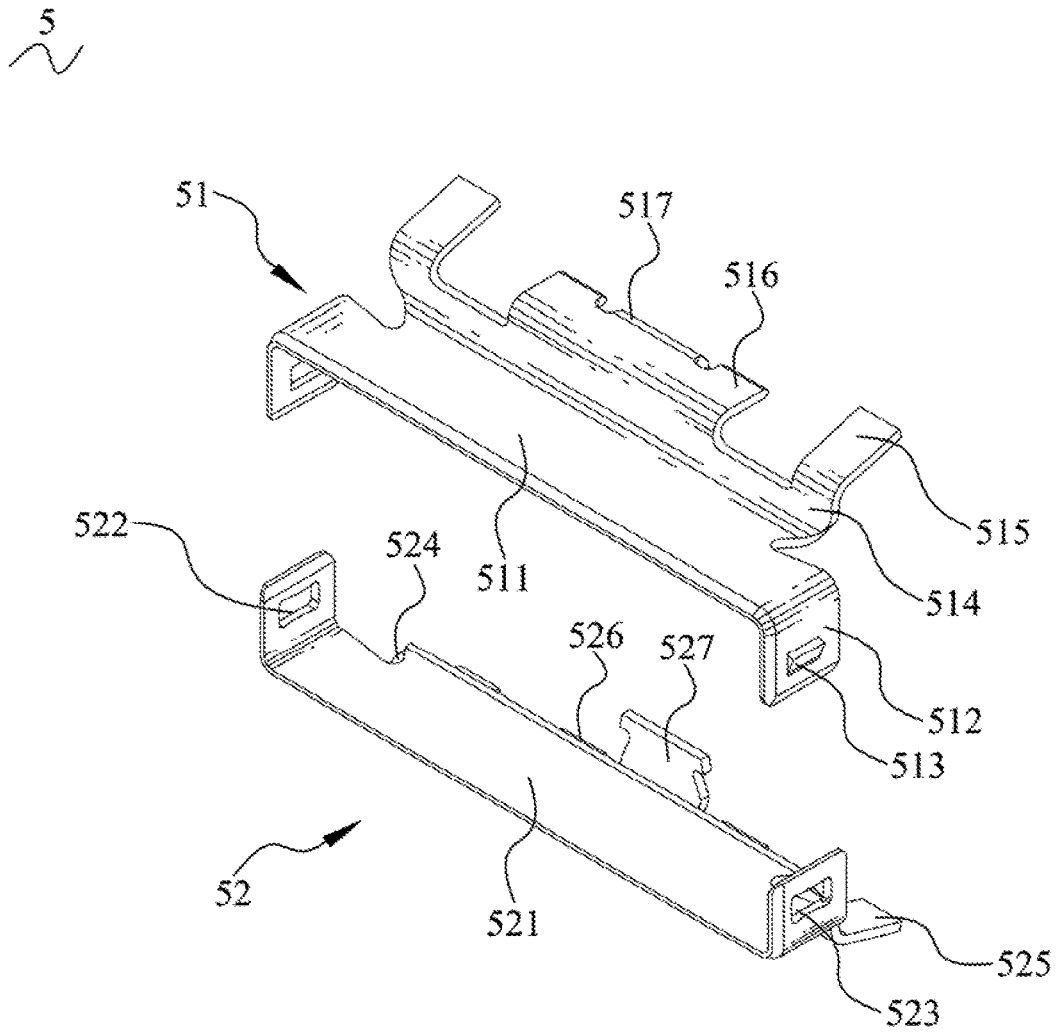
FIG. 12 is a perspective view of the inner shielding shell assembly of the electrical connector of FIG. 1.
Figure 13:
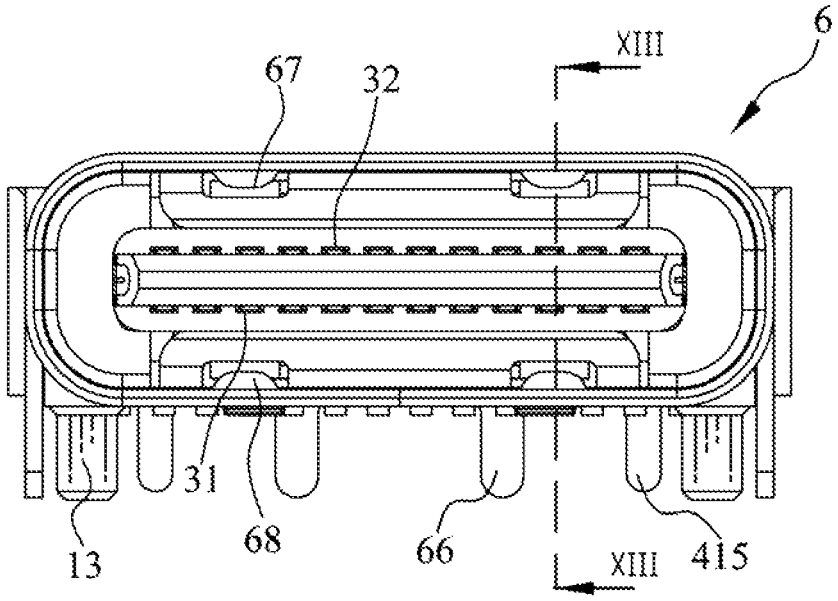
FIG. 13 is a front view of the electrical connector of FIG. 1.
Figure 14:
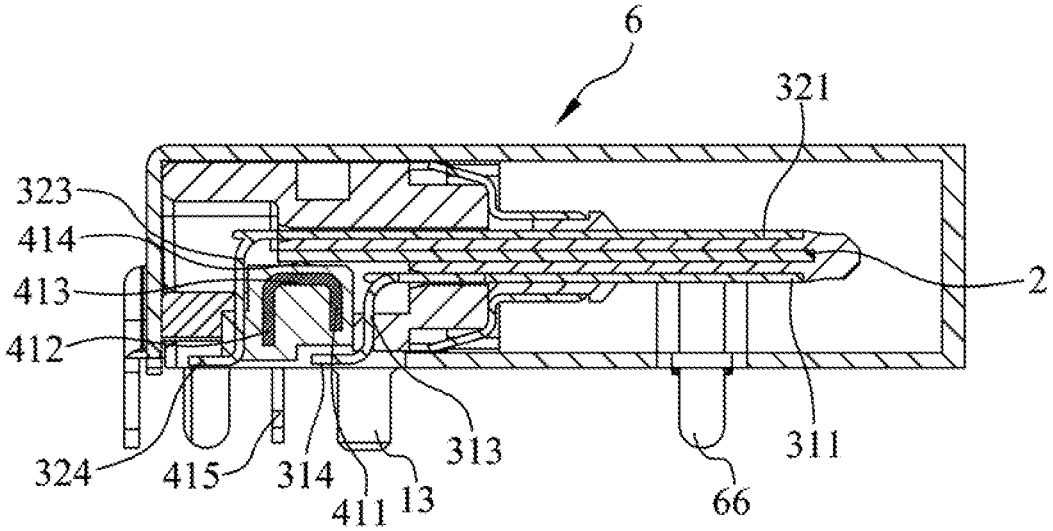
FIG. 14 is a sectional view of the electrical connector along a line XIII-XIII of FIG. 13.

Referring to FIG. 3 and FIG. 10, the shielding plate 2 is stamped by a metal plate. The shielding plate 2 has a base plate 21, and an extending plate 22 extended frontward from a middle of a front edge of the base plate 21. The extending plate 22 defines a plurality of locating holes 23. The shielding plate 2 is integrally molded in the insulating housing 1. The base plate 21 is integrally molded in a middle of the base portion 11. The extending plate 22 is integrally molded in a front end of the base portion 11 and the tongue portion 12. The base plate 21 and the extending plate 22 are axially symmetrical structures. The locating holes 23 located at one side of the extending plate 22 are symmetrical to the locating holes 23 located at the other side of the extending plate 22 with respect to center axises of the base plate 21 and the extending plate 22 for fastening the tongue portion 12 and the shielding plate 2. The center axis of the base plate 21 is in alignment with the center axis of the extending plate 22.

A front end of the base plate 21 is of a rectangular shape, and a rear end of the base plate 21 is of a rectangular shape. Two opposite sides of the front end of the base plate 21 project beyond two opposite sides of the rear end of the base plate 21. Two opposite sides of the front end of the base plate 21 are defined as two cutting ends 211. Material strips are connected with and cut from the cutting ends 211. So outer surfaces of the two cutting ends 211 are exposed to the two perforations 14, respectively.

The extending plate 22 has a connecting plate 221 extended frontward from a middle of the front end of the base plate 21, and a fixing plate 222 spread outward and then extended frontward from a front end of the connecting plate 221. The connecting plate 221 is molded in a rear end of the tongue portion 12 and the front end of the base portion 11.

Referring to FIG. 3, FIG. 9, FIG. 10 and FIG. 11, front ends of the conductive terminals 3 are exposed to the tongue portion 12. The conductive terminals 3 include a plurality of first terminals 31 and a plurality of second terminals 32. The first terminals 31 and the second terminals 32 are stamped by metal. The first terminals 31 and the second terminals 32 have similar shape. Specifically, each of the first terminals 31 has a first contact portion 311, a first fastening portion 312 extended rearward from a rear end of the first contact portion 311, a first bent portion 313 bent downward from a rear end of the first fastening portion 312, and a first solder portion 314 extended rearward from a bottom of the first bent portion 313. Each of the second terminals 32 has a second contact portion 321, a second fastening portion 322 extended rearward from a rear end of the second contact portion 321, a second bent portion 323 bent downward from a rear end of the second fastening portion 322, and a second solder portion 324 extended rearward from a bottom of the second bent portion 323. The first terminals 31 are located above and without contacting the shielding plate 2. The second terminals 32 are located under the shielding plate 2 and without contacting the shielding plate 2.

The first terminals 31 are received in the insulating housing 1. The first terminals 31 are mounted to the first terminal grooves 117. The second terminals 32 are received in the insulating housing 1. The second terminals 32 are mounted to the second terminal grooves 118. The shielding plate 2 is located between and spaced from the first terminals 31 and the second terminals 32. So the electrical connector 100 is inserted by the butting connector to respectively realize a normal insertion and a reverse insertion. The first contact portions 311 of the first terminals 31 are exposed to the bottom surface of the tongue portion 12. The first fastening portions 312 of the first terminals 31 are fastened in the base portion 11. The first fastening portions 312 of the first terminals 31 are fastened in the first terminal grooves 117. The first bent portions 313 of the first terminals 31 are received in the assembling opening 115. The first soldering portions 314 of the first terminals 31 are exposed outside from the assembling opening 115. The second contact portions 321 of the second terminals 32 are exposed to the top surface of the tongue portion 12. The second fastening portions 322 of the second terminals 32 are fastened in the base portion 11. The second fastening portions 322 of the second terminals 32 are fastened in the second terminal grooves 118. The second soldering portions 323 of the second terminals 32 are exposed outside from the assembling opening 115. The second bent portions 324 of the second terminals 32 are received in the assembling opening 115 and located behind the first bent portions 313 of the first terminals 31.

Referring to FIG. 3 to FIG. 11, the ground element 4 has a touch portion 414 for contacting the shielding plate 2. The ground element 4 includes a grounding conductor 41 for being connected between the shielding plate 2 and the ground, and a dielectric body 42. The grounding conductor 41 is received in the base portion 11. The grounding conductor 41 is stamped to form a single piece structure. The grounding conductor 41 has a rear plate 412 substantially disposed vertically, a front plate 411 facing to and parallel with the rear plate 412, and a connecting portion 413 connected between the front plate 411 and the rear plate 412. The grounding conductor 41 further includes the touch portion 414. The touch portion 414 is shown a bar shape. The touch portion 414 is a guiding bar which is protruded upward and then slantwise extended upward and rearward from a top of the front plate 411 of the grounding conductor 41. A bottom of the rear plate 412 of the grounding conductor 41 extends downward to form a grounding portion 415 for connecting with the ground. Specifically, the grounding conductor 41 includes two spaced connecting portions 413 connected between the front plate 411 and the rear plate 412 of the grounding conductor 41. Two opposite sides of the top of the front plate 411 protrude upward and then slantwise extend upward and rearward to form two touch portions 414. The two touch portions 414 are located between the two connecting portions 413. The two touch portions 414 are adjacent to the two connecting portions 413, respectively. Tail ends of the two touch portions 414 project beyond top surfaces of the two connecting portions 413. Two opposite sides of the bottom of the rear plate 412 extend downward to form two grounding portions 415.

The dielectric body 42 is integrally molded to the grounding conductor 41. The dielectric body 42 has a top face 421, a rear face 425, a bottom face 426 and two side faces 427. The top face 421 of the dielectric body 42 is located above the two connecting portions 413. The rear face 425 of the dielectric body 42 is located behind the rear plate 412. The top face 421 of the dielectric body 42 is recessed downward to form a receiving opening 422. Two opposite sides of the top face 421 of the dielectric body 42 are recessed downward to form two receiving openings 422. Several portions of the rear face 425 of the dielectric body 42 protrude rearward to form a plurality of protruding blocks 428. Every adjacent two of the protruding blocks 428 are spaced from each other to form a locating slot 423 therebetween. The two side faces 427 of the dielectric body 42 protrude outward and then extend rearward to form two restricting portions 424.

The touch portion 414 projects beyond the top face 421 of the dielectric body 42. The grounding portion 415 projects beyond the bottom face 426 of the dielectric body 42. The touch portion 414 is received in the receiving opening 422. Specifically, the two touch portions 414 are received in the two receiving openings 422. The two touch portions 414 project beyond the top face 421 of the dielectric body 42. The two grounding portions 415 project beyond the bottom face of the dielectric body 42.

The ground element 4 is received in the assembling opening 115. The ground element 4 is located between the first bent portions 313 of the first terminals 31 and the second bent portions 323 of the second terminals 32. The front plate 411 of the grounding conductor 41 is corresponding to and spaced from the first bent portions 313 of the first terminals 31. The rear plate 412 of the grounding conductor 41 is corresponding to and spaced from the second bent portions 323 of the second terminals 32. In this embodiment, a distance between the front plate 411 of the grounding conductor 41 and the first bent portions 313 of the first terminals 31 is substantially equal to a distance between the rear plate 412 of the grounding conductor 41 and the second bent portions 323 of the second terminals 32. So the first terminals 31 and the second terminals 32 are capable of achieving better signal transmission effects.

The two restricting portions 424 of the dielectric body 42 are restricted in the two restricting grooves 116 of the insulating housing 1 for restricting the ground element 4 to the insulating housing 1 stably. The ground element 4 is located under the shielding plate 2. The touch portion 414 contacts the shielding plate 2. The two touch portions 414 contact the base plate 21 of the shielding plate 2. The two grounding portions 415 project under the bottom surface of the base portion 11 and are connected with the circuit board.

Referring to FIG. 3, FIG. 9, FIG. 10 and FIG. 12, the inner shielding shell assembly 5 includes an upper shell 51, and a lower shell 52 matched with the upper shell 51. The upper shell 51 has a first main plate 511. Two opposite sides of the first main plate 511 are bent downward to form two first buckling arms 512. The two first buckling arms 512 are punched outward to form two buckling pieces 513. A rear edge of the first main plate 511 is bent upward to form a first bending plate 514. Two opposite sides of a top edge of the first bending plate 514 are slantwise extended upward and rearward to form two first resilient arms 515. A middle of the top edge of the first bending plate 514 is bent rearward to form a first auxiliary plate 516. A middle of a rear edge of the first auxiliary plate 516 extends downward to form a first locking portion 517. The upper shell 51 is received in the receiving groove 123. The first main plate 511 is received in a top of the receiving groove 123 and spaced from the second terminals 32. The first bending plate 514 abuts against an upper portion of the front surface of the base portion 11. The two first resilient arms 515 of the upper shell 51 are resiliently disposed over the two first recesses 111. The first auxiliary plate 516 is mounted on the top surface of the base portion 11. The first locking portion 517 is locked in the first locking groove 112.

The lower shell 52 has a second main plate 521. Two opposite sides of the second main plate 521 are bent upward to form two second buckling arms 522. The two second buckling arms 522 define two buckling holes 523, respectively. A rear edge of the second main plate 521 is bent downward to form a second bending plate 524. Two opposite sides of a bottom edge of the second bending plate 524 are slantwise extended downward and rearward to form two second resilient arms 525. A middle of the bottom edge of the second bending plate 524 is bent rearward to form a second auxiliary plate 526. A middle of a rear edge of the second auxiliary plate 526 extends upward to form a second locking portion 527. The lower shell 52 is received in the receiving groove 123 and matched with the upper shell 51. The second main plate 521 is received in a bottom of the receiving groove 123 and space from the first terminals 31. The two second buckling arms 522 are received in the two opposite sides of the receiving groove 123. The two buckling pieces 513 are buckled in the two buckling holes 523, respectively. The second bending plate 524 abuts against a lower portion of the front surface of the base portion 11. The two second resilient arms 525 of the lower shell 52 are resiliently disposed under the two second recesses 113. The second auxiliary plate 526 is mounted on the bottom surface of the base portion 11. The second locking portion 527 is locked in the second locking groove 114.

Referring to FIG. 1, FIG. 2 and FIG. 3, the outer shielding shell 6 surrounds the insulating housing 1 together with the shielding plate 2, the conductive terminals 3, the ground element 4 and the inner shielding shell assembly 5. An insertion space 7 is formed between the outer shielding shell 6 and the insulating housing 1. The outer shielding shell 6 has a top plate 61, two lateral plates 62 extended downward from two opposite sides of the top plate 61, a bottom plate 63 connected between bottoms of front ends of the two lateral plates 62, a blocking plate 64 connected with rear ends of the top plate 61 and the two lateral plates 62, and an accommodating space 65 is surrounded among a front end of the top plate 61, the front ends of the two lateral plates 62 and the bottom plate 63. A periphery of the outer shielding shell 6 defines a plurality of soldering feet 66.

Two opposite sides of the top plate 61 are punched inward to form two first convex portions 67 projecting into the accommodating space 65. Two opposite sides of the bottom plate 63 are punched inward to form two second convex portions 68 projecting into the accommodating space 65. Two opposite sides of the bottom plate 63 protrude downward to form two locating blocks 69 located in front of the two second convex portions 68. The first resilient arms 515 and the second resilient arms 525 respectively abut against the top plate 61 and the bottom plate 63 of the outer shielding shell 6 and received in the first recesses 111 and the second recesses 113.

Referring to FIG. 1 to FIG. 14, a manufacturing process of the electrical connector 100 is described as follows. Firstly, the shielding plate 2, the conductive terminals 3, the grounding conductor 41, the inner shielding shell assembly 5 and the outer shielding shell 6 are formed by a stamping technology. Secondly, the shielding plate 2 is integrally molded in the insulating housing 1. The dielectric body 42 is integrally molded to the grounding conductor 41 to form the ground element 4. Thirdly, the first terminals 31 are mounted to the insulating housing 1. Fourthly, the ground element 4 is assembled in the assembling opening 115 of the base portion 11. Fifthly, the second terminals 32 are mounted to the insulating housing 1 with the second bent portions 323 located in the assembling opening 115. Then, the inner shielding shell assembly 5 is mounted in the receiving groove 123. The two first buckling arms 512 together with the two buckling pieces 513 and the two second buckling arms 522 together with the two buckling holes 523 are received in two opposite sides of the receiving groove 123.

The outer shielding shell 6 is mounted around the insulating housing 1. A rear end of the outer shielding shell 6 is mounted to the base portion 11. The tongue portion 12 is inserted into the accommodating space 65 of the outer shielding shell 6. The two first convex portions 67 are blocked in the two first recesses 111 and without contacting the first resilient arms 515. The two second convex portions 68 are blocked in the two second recesses 113 and without contacting the first resilient arms 515. Bottom surfaces of the first solder portions 314 of the first terminals 31, bottom surfaces of the second solder portions 324 of the second terminals 32, and bottom surfaces of the two locating blocks 69 are flush. The soldering feet 66 of the electrical connector 100 are soldered to the circuit board to connect with ground.

As described above, the touch portion 414 of the ground element 4 contacts the shielding plate 2 to make the shielding plate 2 realize a ground function, so the shielding plate 2 has a simpler and shorter structure, and a mold for making the shielding plate 2 is simpler and litter. Furthermore, the distance between the front plate 411 of the grounding conductor 41 and the first bent portions 313 of the first terminals 31 is substantially equal to the distance between the rear plate 412 of the grounding conductor 41 and the second bent portions 323 of the second terminals 32 for resisting high-frequency noises, so the high-frequency noises are decreased. As a result, a process problem of making the shielding plate 2 is improved, and a defect rate of the shielding plate 2 is lowered.

What is claimed is:

1. An electrical connector, comprising:

an insulating housing having a base portion, and a tongue portion connected to a front surface of the base portion;

a plurality of conductive terminals received in the insulating housing, and front ends of the conductive terminals being exposed to the tongue portion;

a shielding plate received in the insulating housing; and a ground element for being connected between the shielding plate and ground, the ground element being received in the insulating housing, the ground element having a touch portion contacting the shielding plate;

wherein the ground element includes a grounding conductor, the grounding conductor has a rear plate, a front plate facing to the rear plate, and a connecting portion connected between the front plate and the rear plate, the touch portion is shown a bar shape and protruded upward and then slantwise extended upward and rearward from a top of the front plate of the grounding conductor, a bottom of the rear plate of the grounding conductor extends downward to form a grounding portion for connecting with the ground;

wherein the ground element includes a dielectric body integrally molded to the grounding conductor, the touch portion projects beyond a top face of the dielectric body, and the grounding portion projects beyond a bottom face of the dielectric body.

2. The electrical connector as claimed in claim 1, wherein the top face of the dielectric body is recessed downward to form a receiving opening, the touch portion is received in the receiving opening.

3. The electrical connector as claimed in claim 1, wherein the conductive terminals include a plurality of first terminals and a plurality of second terminals, each of the first terminals has a first contact portion exposed to a bottom surface of the tongue portion, and a first fastening portion extended rearward from a rear end of the first contact portion to be fastened in the base portion, each of the second terminals has a second contact portion exposed to a top surface of the tongue portion, and a second fastening portion extended rearward from a rear end of the second contact portion to be fastened in the base portion.

4. The electrical connector as claimed in claim 3, wherein the base portion defines an assembling opening penetrating through a rear of a bottom surface and a rear surface of the base portion, the ground element is received in the assembling opening, each of the first terminals has a first bent portion bent downward from a rear end of the first fastening portion, each of the second terminals has a second bent portion bent downward from a rear end of the second fastening portion, the first bent portions of the first terminals are received in the assembling opening, the second bent portions of the second terminals are received in the assembling opening and located behind the first bent portions.

5. The electrical connector as claimed in claim 4, wherein the ground element is located between the first bent portions of the first terminals and the second bent portions of the second terminals, the front plate of the grounding conductor is corresponding to and spaced from the first bent portions of the first terminals, the rear plate of the grounding conductor is corresponding to and spaced from the second bent portions of the second terminals.

6. An electrical connector, comprising:

an insulating housing having a base portion, and a tongue portion protruded frontward from a front surface of the base portion;

a plurality of first terminals received in the insulating housing, each of the first terminals having a first contact portion exposed to a bottom surface of the tongue portion, a first fastening portion extended rearward from a rear end of the first contact portion to be fastened in the base portion, and a first bent portion bent downward from a rear end of the first fastening portion;

a plurality of second terminals received in the insulating housing, each of the second terminals having a second contact portion exposed to a top surface of the tongue portion, a second fastening portion extended rearward from a rear end of the second contact portion to be fastened in the base portion, and a second bent portion bent downward from a rear end of the second fastening portion and located behind the first bent portion of each of the first terminals;

a shielding plate received in the insulating housing; and a grounding conductor for being connected between the shielding plate and ground, the grounding conductor being received in the base portion, the grounding conductor having a rear plate corresponding to and spaced from the second bent portions of the second terminals, a front plate corresponding to and spaced from the first bent portions of the first terminals, and a touch portion contacting the shielding plate;

wherein a distance between the front plate of the grounding conductor and the first bent portions of the first terminals is substantially equal to a distance between the rear plate of the grounding conductor and the second bent portions of the second terminals.

7. The electrical connector as claimed in claim 6, wherein the touch portion is a guide bar protruded upward and then slantwise extended upward and rearward from a top of the front plate of the grounding conductor.

8. The electrical connector as claimed in claim 6, wherein the grounding conductor has a connecting portion connected between the front plate and the rear plate, a bottom of the rear plate of the grounding conductor extends downward to form a grounding portion for connecting with the ground.

9. The electrical connector as claimed in claim 8, further comprising a ground element, the ground element including the grounding conductor, and a dielectric body integrally molded to the grounding conductor, the touch portion projecting beyond a top face of the dielectric body, and the grounding portion projecting beyond a bottom face of the dielectric body.

10. The electrical connector as claimed in claim 9, wherein the top face of the dielectric body is recessed downward to form a receiving opening, the touch portion is received in the receiving opening.

11. The electrical connector as claimed in claim 9, wherein the grounding conductor includes two spaced connecting portions connected between the front plate and the rear plate of the grounding conductor, two opposite sides of the top of the front plate protrude upward and then slantwise extend upward and rearward to form two touch portions located between the two connecting portions and projecting beyond the top face of the dielectric body, the two touch portions are adjacent to the two connecting portions, respectively, two opposite sides of a bottom of the rear plate extend downward to form two grounding portions projecting beyond the bottom face of the dielectric body.

12. The electrical connector as claimed in claim 11, wherein two opposite sides of the top face of the dielectric body are recessed downward to form two receiving openings, the two touch portions are received in the two receiving openings.

13. The electrical connector as claimed in claim 9, wherein the base portion defines an assembling opening penetrating through a rear of a bottom surface and a rear surface of the base portion, the ground element is received in the assembling opening, the first bent portions of the first terminals and the second bent portions of the second terminals are received in the assembling opening.

* * * * *